US005842464A

United States Patent [19]

Koch

[11] Patent Number: 5,842,464

[45] Date of Patent: Dec. 1, 1998

[54] STOVE SAFETY GUARD SYSTEM

[76] Inventor: Vivian R. Koch, 334 Viking Dr., Corpus Christie, Tex. 78418

[21] Appl. No.: 852,057

[22] Filed: May 6, 1997

[51] Int. Cl.[6] ..... F24C 3/12

[52] U.S. Cl. ..... 126/42; 126/211; 126/214 D; 126/299 R

[58] Field of Search ..... 126/42, 211, 214 D, 126/214 R, 299 R, 299 D, 212, 215, 216, 299 C

[56] References Cited

U.S. PATENT DOCUMENTS

| | | | |
|---|---|---|---|
| 1,954,257 | 4/1934 | Nessel | 126/301 |
| 4,625,708 | 12/1986 | Beall | 126/42 |
| 4,788,964 | 12/1988 | Dorsey et al. | 126/299 R |
| 4,836,181 | 6/1989 | Saga | 126/42 |
| 4,922,888 | 5/1990 | Bryan et al. | 126/42 |
| 5,076,255 | 12/1991 | Harrison | 126/211 |
| 5,357,943 | 10/1994 | Edgerton | 126/214 |
| 5,438,974 | 8/1995 | Maldonado | 126/211 |
| 5,678,532 | 10/1997 | Wu | 126/299 R |

*Primary Examiner*—James C. Yeung
*Attorney, Agent, or Firm*—Joseph N. Breaux

[57] ABSTRACT

A stove safety guard system that includes a lower safety guard that is detachably attachable to the side walls of a stove unit and supported in the front by the oven handle and an upper safety guard that is detachably secured to the upper and side exterior surfaces of the exhaust hood of the stove unit.

4 Claims, 3 Drawing Sheets

STOVE SAFETY GUARD SYSTEM

TECHNICAL FIELD

The present invention relates to kitchen safety devices and more particularly to a stove safety guard system for use with a stove having an exhaust vent wherein the safety guard system includes a lower safety guard, an upper safety guard and six detachable attachment mechanisms; and wherein the lower safety guard includes a rectangular lower front-guard member having a left end edge and a right end edge, a lower left-guard member extending perpendicularly from the left end edge of the lower front-guard member to form a first right angled corner, a lower right-guard member extending perpendicularly from the right end edge of the lower front-guard member to form a second right angled corner, a left downwardly depending support brace extending downwardly from the lower left-guard member and the lower front guard member, and a right downwardly depending support brace extending downwardly from the lower right-guard member and the lower front-guard member; the upper safety guard includes a deflecting assembly interconnected to a hood attachment assembly, the deflecting assembly including a deflecting member having a triangular-shaped, left upper-side guard member and a triangular-shaped, right upper-side guard member, the hood attachment assembly including a rectangular-shaped attachment member having an interconnecting side edge in connection with the deflecting member of the deflecting assembly, a front side edge, a left side edge and a right side edge; a left side upper attachment member extending perpendicularly from the left side edge of the rectangular-shaped attachment member and in connection with the triangular-shaped left upper-side guard member, a right side upper guard attachment member extending perpendicularly from the right side edge of the rectangular-shaped attachment member and in connection with the triangular-shaped right upper-side guard member; and each of the six detachable attachment mechanisms each includes a securing bar, one of the six detachable attachment mechanisms extending outwardly from the lower left-guard member, another one of the six detachable attachment mechanisms extending outwardly from the lower right-guard member, another one of the six detachable attachment mechanisms extending outwardly from the left side upper attachment member, another one of the six detachable attachment mechanisms extending outwardly from the right side upper attachment member, and two of the six detachable attachment mechanisms extending outwardly from the rectangular-shaped attachment member.

BACKGROUND OF THE INVENTION

Because a stove must generate sufficient heat to cook, stoves are dangerous areas. It would be desirable, therefore, to have a stove safety guard that could be attached to a stove to prevent small children from accessing the front and top of the stove unit. In addition, because splattering grease can pose a significant risk of injury, it would also be desirable to have a stove safety guard system that included a safety guard that could be attached to the hood of a stove unit to block splattering grease generated while cooking on the stove top.

SUMMARY OF THE INVENTION

It is thus an object of the invention to provide a stove safety guard system that includes a lower safety guard that is attachable to a stove to block access to the front and top of the stove unit by small children.

It is a further object of the invention to provide a stove safety guard system that includes an upper safety guard that is attachable to the hood of a stove unit to block splattering grease generated while cooking on the stove top.

It is a still further object of the invention to provide a stove safety guard system that includes a lower safety guard, an upper safety guard and six detachable attachment mechanisms; and wherein the lower safety guard includes a rectangular lower front-guard member having a left end edge and a right end edge, a lower left-guard member extending perpendicularly from the left end edge of the lower front-guard member to form a first right angled corner, a lower right-guard member extending perpendicularly from the right end edge of the lower front-guard member to form a second right angled corner, a left downwardly depending support brace extending downwardly from the lower left-guard member and the lower front guard member, and a right downwardly depending support brace extending downwardly from the lower right-guard member and the lower front-guard member; the upper safety guard includes a deflecting assembly interconnected to a hood attachment assembly, the deflecting assembly including a deflecting member having a triangular-shaped, left upper-side guard member and a triangular-shaped, right upper-side guard member, the hood attachment assembly including a rectangular-shaped attachment member having an interconnecting side edge in connection with the deflecting member of the deflecting assembly, a front side edge, a left side edge and a right side edge; a left side upper attachment member extending perpendicularly from the left side edge of the rectangular-shaped attachment member and in connection with the triangular-shaped left upper-side guard member, a right side upper guard attachment member extending perpendicularly from the right side edge of the rectangular-shaped attachment member and in connection with the triangular-shaped right upper-side guard member; and each of the six detachable attachment mechanisms each includes a securing bar, one of the six detachable attachment mechanisms extending outwardly from the lower left-guard member, another one of the six detachable attachment mechanisms extending outwardly from the lower right-guard member, another one of the six detachable attachment mechanisms extending outwardly from the left side upper attachment member, another one of the six detachable attachment mechanisms extending outwardly from the right side upper attachment member, and two of the six detachable attachment mechanisms extending outwardly from the rectangular-shaped attachment member.

It is a still further object of the invention to provide a stove safety guard system that accomplishes some or all of the above objects in combination.

Accordingly, a stove safety guard system is provided. The stove safety guard system includes a lower safety guard, an upper safety guard and six detachable attachment mechanisms. The lower safety guard includes a rectangular lower front-guard member having a left end edge and a right end edge, a lower left-guard member extending perpendicularly from the left end edge of the lower front-guard member to form a first right angled corner, a lower right-guard member extending perpendicularly from the right end edge of the lower front-guard member to form a second right angled corner, a left downwardly depending support brace extending downwardly from the lower left-guard member and the lower front guard member, and a right downwardly depending support brace extending downwardly from the lower right-guard member and the lower front-guard member. The upper safety guard includes a deflecting assembly interconnected to a hood attachment assembly, the deflecting assembly including a deflecting member having a triangular-shaped, left upper-side guard member and a triangular-shaped, right upper-side guard member, the hood attachment assembly including a rectangular-shaped attachment member having an interconnecting side edge in connection with the deflecting member of the deflecting assembly, a front side edge, a left side edge and a right side edge; a left side upper attachment member extending perpendicularly from the left side edge of the rectangular-shaped attachment member and in connection with the triangular-shaped left upper-side guard member, a right side upper guard attachment member extending perpendicularly from the right side edge of the rectangular-shaped attachment member and in connection with the triangular-shaped right upper-side guard member. Each of the six detachable attachment mechanisms includes a securing bar. One of the six detachable attachment mechanisms extends outwardly from the lower left-guard member. Another one of the six detachable attachment mechanisms extends outwardly from the lower right-guard member. Another one of the six detachable attachment mechanisms extends outwardly from the left side upper attachment member. Another one of the six detachable attachment mechanisms extend outwardly from the right side upper attachment member. Two of the six detachable attachment mechanisms extend outwardly from the rectangular-shaped attachment member.

In one preferred embodiment each of the six detachable attachment mechanisms includes a suction cup secured to a free end of the securing bar. In another preferred embodiment each of the six detachable attachment mechanisms includes a permanent magnet secured to a free end of the securing bar. In still another preferred embodiment each of the six detachable attachment mechanisms includes a vise assembly that extends from the securing bar and a separate channel member having an adhesive surface provided on one side surface thereof for attaching the channel member to the exterior surface of the stove unit and a clamping member that is clampable between the securing bar and the contact plate of the vise assembly.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
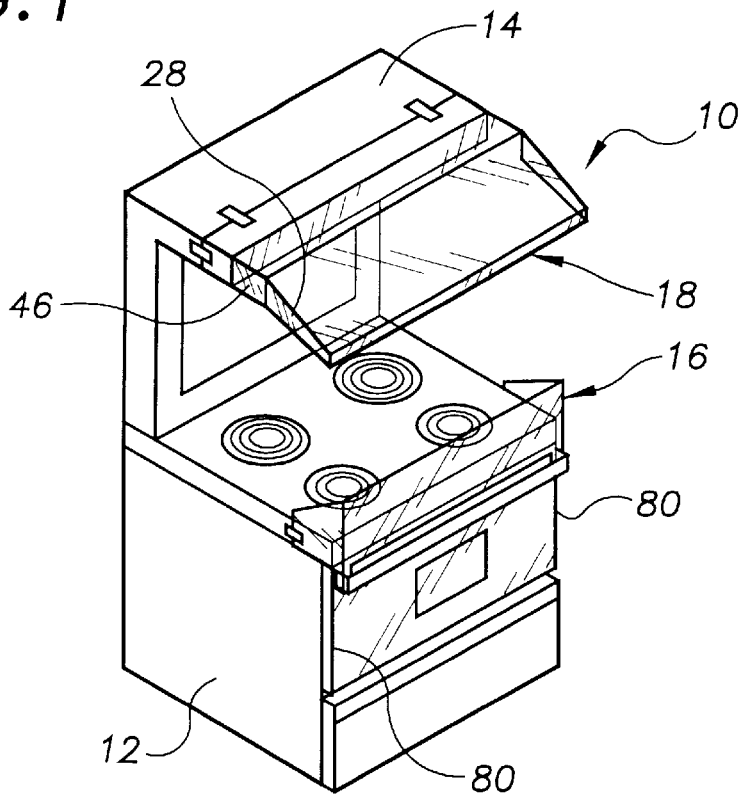
FIG. 1 has a perspective view of an exemplary embodiment of the stove safety guard system of the present invention in use with a representative stove having an attached exhaust hood showing the lower safety guard detachably secured to the side walls of the stove unit and supported in the front by the oven handle and the upper safety guard detachably secured to the upper and side exterior surfaces of the exhaust hood.

FIG. 1 shows an exemplary embodiment of the stove safety guard system of the present invention, generally designated by the numeral 10, in use with a representative stove unit, generally designated 12, having an attached exhaust hood 14. Stove safety system 10 includes a lower safety guard, generally designated 16, and an upper safety guard, generally designated 18. In use, lower safety guard 16 is attached to the front of stove unit 12 to prevent small children from reaching the stove controls and any pots on the stove burners. Upper safety guard 18 is attached to exhaust hood 14 and shields the user from splattering grease and steam jets while cooking.

Figure 2:
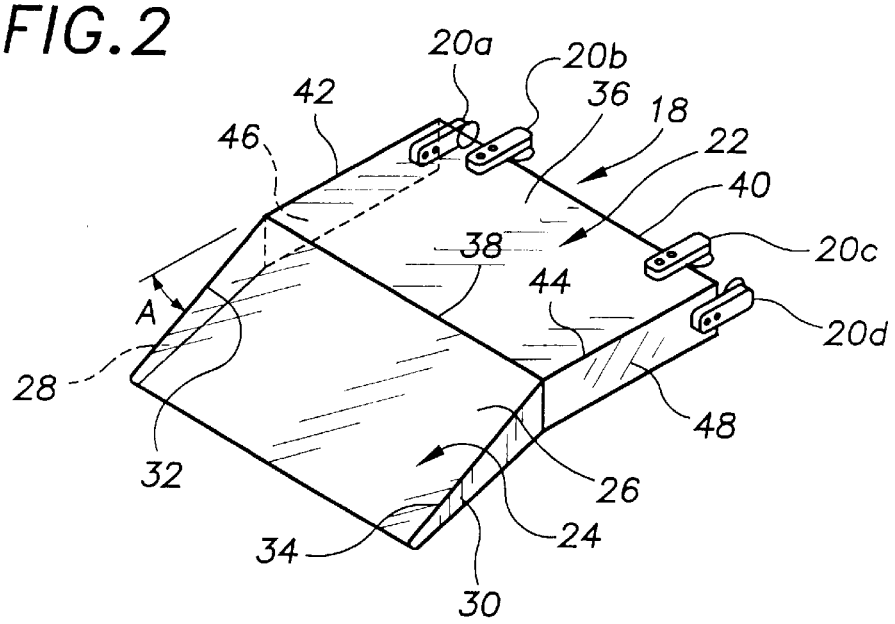
FIG. 2 is a perspective view of the exemplary upper safety guard of the stove safety guard system of the present invention showing the deflecting assembly, the hood attachment assembly, and four of the six exemplary detachable attachment mechanisms.

With reference to FIG. 2, in this embodiment upper safety guard 18 is thermo-molded from tinted acrylic plastic and is detachably securable to exhaust hood 14 (FIG. 1). Upper safety guard 18 includes four identical detachable attachment mechanisms 20*a–d* attached to a hood attachment assembly, generally designated by the numeral 22, and a splatter deflecting assembly, generally designated by the numeral 24, that is interconnected to hood attachment assembly 22 at an angle "A" of about forty-five degrees. Deflecting assembly 24 includes a deflecting member 26, a triangular-shaped, left upper-side guard member 28 (also shown in FIG. 1), and a triangular-shaped, right upper-side guard member 30. Left upper-side guard member 28 is integrally formed with deflecting member 26 along a left deflecting member side edge 32. Right upper-side guard member 30 is integrally formed with deflecting member 26 along a right deflecting member side edge 34.

Hood attachment assembly 22 includes a rectangular-shaped attachment member 36 having an interconnecting side edge 38 in connection deflecting member 26, a front side edge 40, a left side edge 42 and a right side edge 44; a left side upper attachment member 46 (also shown in FIG. 1) that extends perpendicularly from left side edge 42 and in connection with triangular-shaped left upper-side guard member 28; and a right side upper guard attachment member 48 that extends perpendicularly from right side edge 44 and in connection with triangular-shaped right upper-side guard member 30.

Figure 2A:
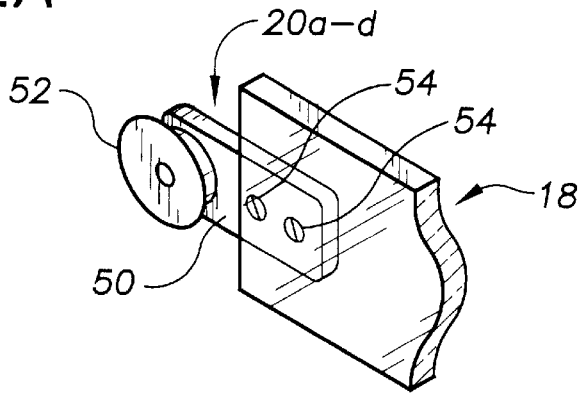
FIG. 2A is a perspective view of one of the six identical exemplary detachable attachment mechanisms of FIGS. 1,2,3 and 4 showing the securing bar secured to the guard structure with a pair of screw fasteners and a suction cup extending from the free end of the securing bar.

One detachable attachment mechanism 20*a* is attached to and extends past left side upper attachment member 46. Another attachment mechanism 20*d* is attached to and extends past right side upper attachment member 48. The remaining two detachable attachment mechanisms 20*b*,20*c* are attached to and extend past rectangular-shaped attachment member 36. In this embodiment, upper safety guard 18 uses detachable attachment mechanisms 20*a–d* as shown in FIG. 2A. Detachable attachment mechanisms 20*a–d* each include a metal securing bar 50 and a suction cup 52. Each securing bar 50 is attached to upper safety guard 18 by two screws 54.

Figure 3:
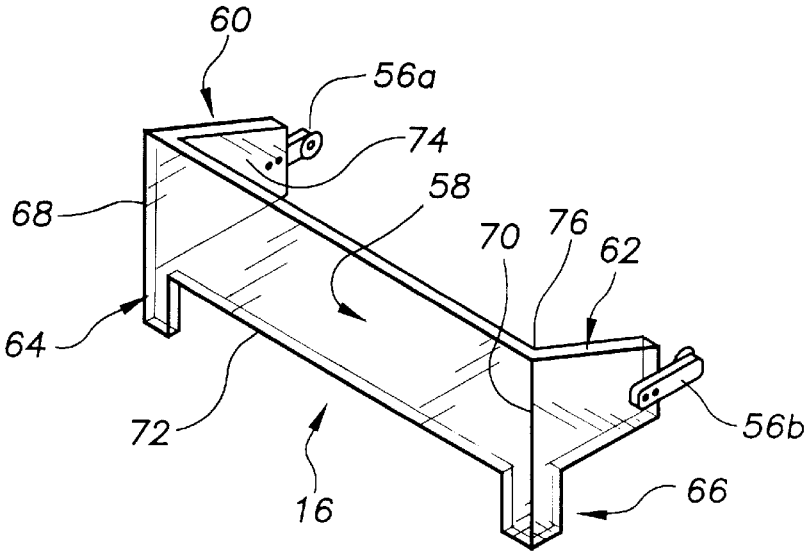
FIG. 3 is a perspective view of the exemplary lower safety guard of the stove safety guard system of the present invention showing the rectangular lower front-guard member, the lower left-guard member, the lower right-guard member, the left and right downwardly depending support braces, and two of the six exemplary detachable attachment mechanisms.

With reference now to FIG. 3, in this embodiment lower safety guard 16 is thermo-molded from tinted acrylic plastic and is detachably securable to the exterior sidewalls of stove unit 12 (FIG. 1). Lower safety guard 16 includes two detachable attachment mechanisms 56*a*,56*b* that are identical in construction to detachable attachment mechanisms 20*a–d*; a rectangular-shaped lower front-guard member, generally designated 58; a lower left-guard member, generally designated 60; a lower right-guard member, generally designated 62; a left downwardly depending support brace, generally designated 64; and a right downwardly depending support brace, generally designated 66.

Rectangular lower front-guard member 58 has a left end edge 68, a right end edge 70, and a lower forward edge 72. Lower left-guard member 60 is integrally formed with left end edge 68 and extends perpendicularly from lower front-guard member 58 to form a first right angled corner 74. Lower right-guard member 62 is integrally formed with right end edge 70 and extends perpendicularly from lower front-guard member 58 to form a second right angled corner 76.

Figure 4:
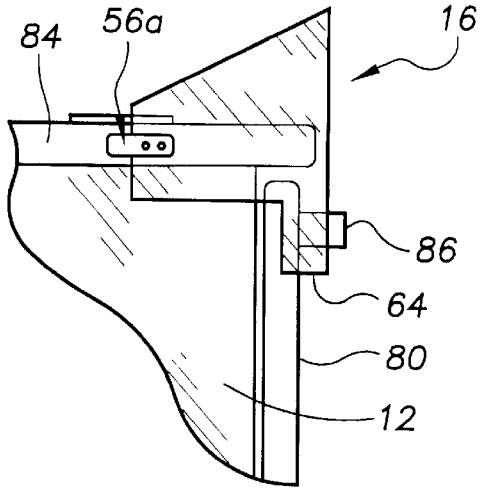
FIG. 4 is a side plan view showing the exemplary lower safety guard of FIG. 3 installed on the representative stove unit with one of the six detachable guard attachment mechanisms attached to the sidewall of the stove unit, the lower forward edge of the lower front-guard member supported on the oven handle of the stove unit, and the left downwardly depending support brace supported against the corner edge of the oven door of the stove unit.

Left downwardly depending support brace 64 extends downwardly away from lower left-guard member 60 and lower front guard member 58. Right downwardly depending support brace 66 extends downwardly away from lower right-guard member 62 and lower front-guard member 58. Left and right downwardly depending support braces 64,66 each form a right angle channel within which a corner edge 80 (FIGS. 1,4) of stove unit 12 is seated when lower safety guard 16 is installed. With reference to FIG. 4, lower safety guard 16 is installed by attaching detachable attachment mechanisms 56*a*,56*b* to the exterior side surface 84 of stove unit 12 and placing lower forward edge 72 (FIG. 3) onto the oven door handle 86 and left and right downwardly depending support braces 64,66 against corner edges 80 of stove unit 12.

Figure 5:
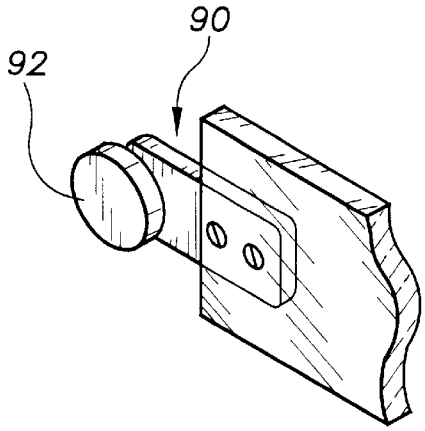
FIG. 5 is a perspective view of a second exemplary detachable guard attachment mechanism of the stove safety guard system of the present invention showing a securing bar secured to the guard structure with a pair of screw fasteners and a permanent magnet extending from the free end of the securing bar.

FIG. 5 shows second exemplary embodiment of a detachable guard attachment mechanism 90 that can be used in place attachment mechanisms 20*a–d* and 56*a–b* (FIGS. 2A,3) if desired. Attachment mechanism 90 is identical to attachment mechanisms 20*a–d* and 56*a–b* except that attachment mechanism 90 includes a permanent magnet 92 in place of a suction cup 52 (FIG. 2A).

Figure 7:
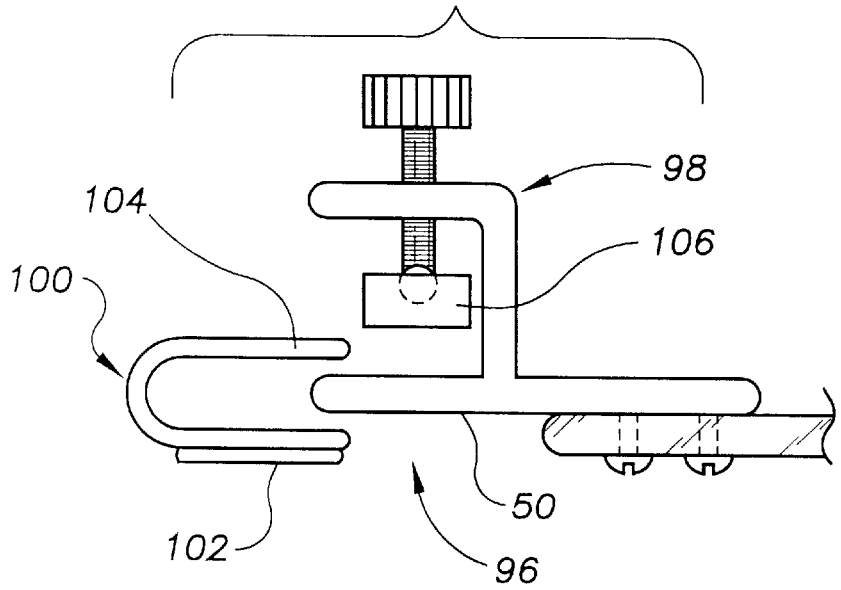
FIG. 7 is a top plan view of the third exemplary detachable attachment mechanism of FIG. 7 showing the screw mechanism and the contact plate of the vise assembly and the clamping member of the channel member partly inserted between the free end of the securing bar and the contact plate of the vise assembly.
Figure 6:
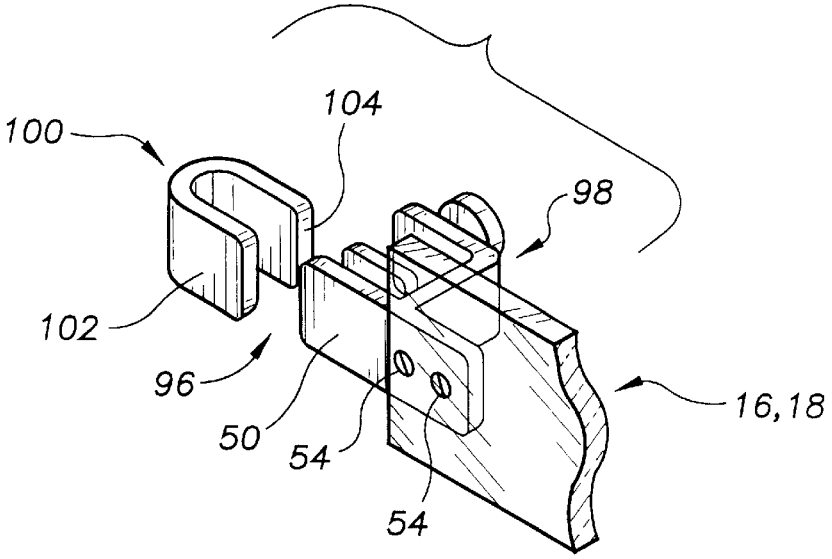
FIG. 6 is a perspective view of a third exemplary detachable attachment mechanism of the stove safety guard system of the present invention showing a securing bar secured to the guard structure with a pair of screw fasteners; a vise assembly extending from the securing bar; and a separate channel member having an adhesive surface provided on one side surface thereof for attaching the channel member to the exterior surface of the stove unit and a clamping member that is clampable between the securing bar and the contact plate of the vise assembly.

FIGS. 6 and 7 show a third exemplary embodiment of a detachable guard attachment mechanism 96 that can also be used in place attachment mechanisms 20*a–d* and 56*a–b* (FIGS. 2A,3) if desired. Attachment mechanism 96 includes a metal securing bar 50 that is attached to safety guards 16,18 by two screws 54; a vise assembly, generally designated 98 that extends from securing bar 50; and a separate channel member, generally designated 100. Channel member 100 is a section of metal channel material having an adhesive surface 102 provided on one side surface thereof that is used for attaching channel member 100 to the exterior surface of a stove unit and a clamping member 104 that is clampable between securing bar 50 and a screw mechanism adjustable contact plate 106 of vise assembly 98.

It can be seen from the preceding description that a stove safety guard system has been provided that includes a lower safety guard that is attachable to a stove to block access to the front and top of the stove unit by small children; that includes an upper safety guard that is attachable to the hood of a stove unit to block splattering grease generated while cooking on the stove top; and that includes a lower safety guard, an upper safety guard and six detachable attachment mechanisms; and wherein the lower safety guard includes a rectangular lower front-guard member having a left end edge and a right end edge, a lower left-guard member extending perpendicularly from the left end edge of the lower front-guard member to form a first right angled corner, a lower right-guard member extending perpendicularly from the right end edge of the lower front-guard member to form a second right angled corner, a left downwardly depending support brace extending downwardly from the lower left-guard member and the lower front guard member, and a right downwardly depending support brace extending downwardly from the lower right-guard member and the lower front-guard member; the upper safety guard includes a deflecting assembly interconnected to a hood attachment assembly, the deflecting assembly including a deflecting member having a triangular-shaped, left upper-side guard member and a triangular-shaped, right upper-side guard member, the hood attachment assembly including a rectangular-shaped attachment member having an interconnecting side edge in connection with the deflecting member of the deflecting assembly, a front side edge, a left side edge and a right side edge; a left side upper attachment member extending perpendicularly from the left side edge of the rectangular-shaped attachment member and in connection with the triangular-shaped left upper-side guard member, a right side upper guard attachment member extending perpendicularly from the right side edge of the rectangular-shaped attachment member and in connection with the triangular-shaped right upper-side guard member; and each of the six detachable attachment mechanisms each includes a securing bar, one of the six detachable attachment mechanisms extending outwardly from the lower left-guard member, another one of the six detachable attachment mechanisms extending outwardly from the lower right-guard member, another one of the six detachable attachment mechanisms extending outwardly from the left side upper attachment member, another one of the six detachable attachment mechanisms extending outwardly from the right side upper attachment member, and two of the six detachable attachment mechanisms extending outwardly from the rectangular-shaped attachment member.

It is noted that the embodiment of the stove safety guard system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A stove safety guard system comprising:

a lower safety guard that is detachably securable to a stove unit, said lower safety guard including:

a rectangular lower front-guard member having a left end edge and a right end edge, a lower left-guard member extending perpendicularly from said left end edge of said lower front-guard member to form a first right angled corner, a lower right-guard member extending perpendicularly from said right end edge of said lower front-guard member to form a second right angled corner, a left downwardly depending support brace extending downwardly from said lower left-guard member and said lower front guard member, and a right downwardly depending support brace extending downwardly from said lower right-guard member and said lower front-guard member;

an upper safety guard that is detachably securable to a hood assembly of a stove unit, said upper safety guard including a deflecting assembly interconnected to a hood attachment assembly, said deflecting assembly including:

a deflecting member, a triangular-shaped, left upper-side guard member attached to said deflecting member along a left deflecting member side edge, and a triangular-shaped, right upper-side guard member attached to said deflecting member along a right deflecting member side edge;

said hood attachment assembly including:

a rectangular-shaped attachment member having an interconnecting side edge in connection with said deflecting member of said deflecting assembly, a front side edge, a left side edge and a right side edge, a left side upper attachment member extending perpendicularly from said left side edge of said rectangular-shaped attachment member and in connection with said triangular-shaped left upper-side guard member, a right side upper guard attachment member extending perpendicularly from said right side edge of said rectangular-shaped attachment member and in connection with said triangular-shaped right upper-side guard member; and six detachable attachment mechanisms, each detachable attachment mechanism including a securing bar, one of said six detachable attachment mechanisms extending outwardly from said lower left-guard member, another one of said six detachable attachment mechanisms extending outwardly from said lower right-guard member, another one of said six detachable attachment mechanisms extending outwardly from said left side upper attachment member, another one of said six detachable attachment mechanisms extending outwardly from said right side upper attachment member, and two of said six detachable attachment mechanisms extending outwardly from said rectangular-shaped attachment member.

2. The stove safety guard system of claim 1, wherein:

each of said six detachable securing mechanisms include a suction cup attached to said securing bar.

3. The stove safety guard system of claim 1, wherein:

each of said six detachable guard attachment mechanisms includes a vise assembly that extends from said securing bar and that includes a screw adjustment mechanism and a contact plate; and a separate channel member that has an adhesive surface provided on one side surface thereof and a clamping member that is positionable and clampable between said securing bar and said contact plate by rotation of said screw adjustment mechanism.

4. The stove safety guard system of claim 1 wherein:

each of said six detachable securing mechanisms include a permanent magnet attached to said securing bar.

* * * * *